US007116538B2

(12) United States Patent
Haensgen et al.

(10) Patent No.: US 7,116,538 B2
(45) Date of Patent: Oct. 3, 2006

(54) MODULAR OVERLOAD RELAY SYSTEM

(75) Inventors: Steven T. Haensgen, Mukwonago, WI (US); Dallas J. Bergh, Waukesha, WI (US); Daniel J. Bolda, Menomonee Falls, WI (US); Donald J. King, Wauwatosa, WI (US); Gary L. Lehman, New Berlin, WI (US)

(73) Assignee: Rockwell Automation Technologies, Inc., Mayfield Hieghts, OH (US)

( * ) Notice: Subject to any disclaimer, the term of this patent is extended or adjusted under 35 U.S.C. 154(b) by 389 days.

(21) Appl. No.: 10/369,272

(22) Filed: Feb. 18, 2003

(65) Prior Publication Data

US 2004/0160718 A1 Aug. 19, 2004

(51) Int. Cl.
*H01H 47/28* (2006.01)

(52) U.S. Cl. ..... 361/93.1; 361/187

(58) Field of Classification Search ..... 361/42–44, 361/161, 165, 170, 187, 93.1, 93.6; 335/132, 335/202, 200

See application file for complete search history.

(56) References Cited

U.S. PATENT DOCUMENTS

| | | | | |
|---|---|---|---|---|
| 5,822,168 | A * | 10/1998 | Boudet et al. | 361/187 |
| 6,196,882 | B1 * | 3/2001 | Sato et al. | 439/701 |
| 6,215,204 | B1 | 4/2001 | Brown et al. | |
| 6,388,563 | B1 | 5/2002 | Brown et al. | |
| 6,459,557 | B1 * | 10/2002 | Haensgen et al. | 361/93.2 |
| 6,788,508 | B1 * | 9/2004 | Papallo et al. | 361/64 |

* cited by examiner

*Primary Examiner*—Brian Sircus
*Assistant Examiner*—Danny Nguyen
(74) *Attorney, Agent, or Firm*—Quarles & Brady, LLP; Alexander M. Gerasimow

(57) ABSTRACT

A modular overload relay provides a low cost analog base unit performing overload detection functions and one or more add-on units communicating with the base unit through an electric conductor on a side of the base unit to which the add-on module may be attached. The add-on units augment the circuitry of the base unit through additional analog or microprocessor-based circuitry communicating with various points within the analog circuitry of the base unit.

22 Claims, 2 Drawing Sheets

FIG. 1
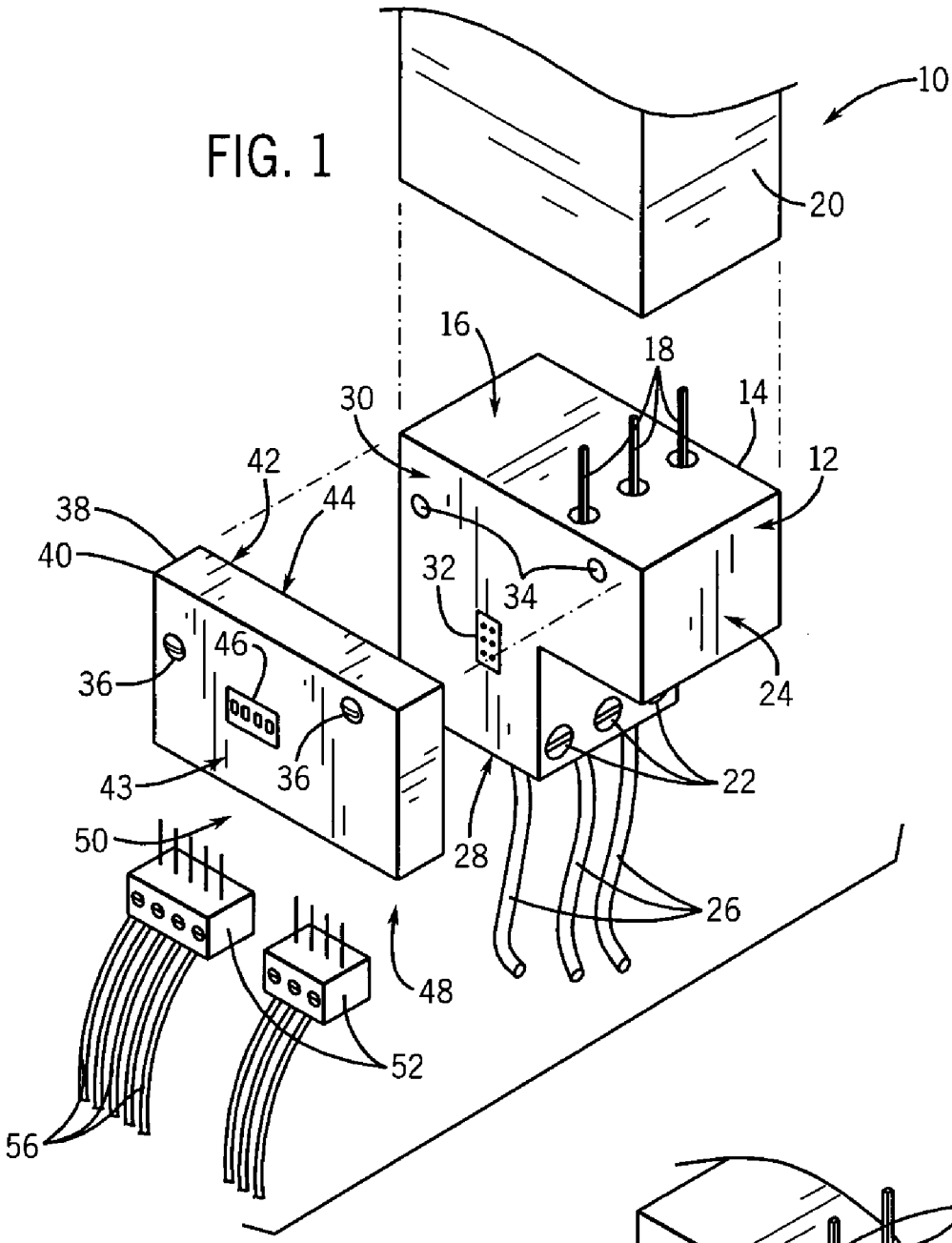
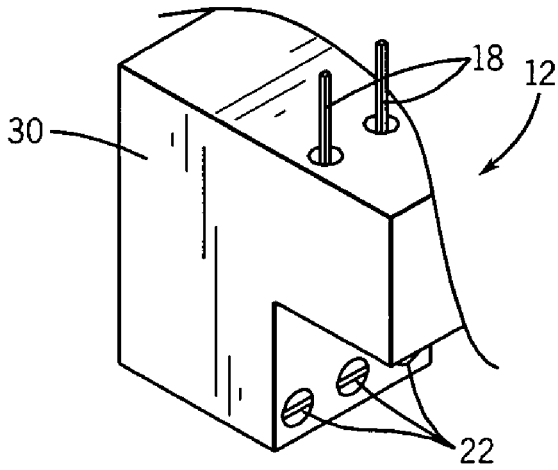
FIG. 2

MODULAR OVERLOAD RELAY SYSTEM

CROSS-REFERENCE TO RELATED APPLICATIONS

STATEMENT REGARDING FEDERALLY SPONSORED RESEARCH OR DEVELOPMENT

BACKGROUND OF THE INVENTION

Overload relays are current sensitive relays, normally used in conjunction with an electomechanical contactor, that may be used to disconnect power from equipment, for example, from a three-phase motor, when an overload condition exists.

In a typical installation, the contactor provides three contacts, one associated with each of the three phases of power, closed by an electromagnetically operated armature. The overload relay includes current sensing elements that are wired in series with the three phases passing through the contactor. In this way, the overload relay can monitor current flowing in the three phases through the contactor, and based on current magnitude and duration, may interrupt the current flow through the contactor armature circuit to open the contactor contacts when an overload occurs. For this purpose, the overload relay includes a set of latching contacts which can be used to control the contactor coil and/or provide a signal indicating an overload conditions.

Generally, an overload relay provides a different protective function than that of a circuit breaker which may also be wired in series with the contactor and overload relay.

Simple overload relays make use of mechanical elements, such as bimetallic strips for current sensing, communicating with contacts for providing a switched output. It is known, however, to construct overload relays from solid-state analog circuit components using current transformers for the current sensing element. Power for the solid-state analog overload relays is obtained through separate wiring or may be tapped from the secondary windings of the current transformers. The solid-state analog circuitry may be implemented in an application specific integrated circuit (ASIC) making the solid-state overload re-lay inexpensive and reliable.

It may be desirable to incorporate additional features into an overload relay, for example, to allow it to check for three-phase current imbalance, ground faults, or motor jam conditions. Remote operation and monitoring of the overload relay, for example, may also be desirable. These latter features may be implemented by providing dedicated wiring, to communicate, for example, a reset signal to the overload relay, or by providing the overload relay with a network connection, allowing serial digital data to pass between the overload relay and a separate controller.

When one or more of these additional functions is required, the analog circuitry of the overload relay is normally replaced with a microprocessor or microcontroller-based circuit. Measured current from the current transformers of the overload relay may be converted to digital values by an analog to digital converter and the base and supplemental protective functions are implemented in the microcontroller's firmware. The microcontroller may further implement a network interface allowing the overload relay to communicate with external sources for external control and readout of the overload relay function.

The use of a microcontroller in an overload relay substantially increases the cost of the overload relay, both because of the cost of the microcontroller but also because of the ancillary circuitry needed to support the microprocessor including power processing circuits, clock circuits, start-up circuits, memory and other interface circuits, and so-called "glue" logic circuits. Accordingly, additional overload relay functions are normally available only in feature rich, high priced overload relays. Mid-tier overload relays for users who need only a single additional feature, for example, represent a relatively low volume (fragmented by the number of different mid-tier products that are possible) making manufacturers reluctant to address this market.

BRIEF SUMMARY OF THE INVENTION

The present invention provides a),modular overload relay in which the base overload relay module uses low cost analog circuitry. A side-mounted connector allows an added-function module to be attached to the base module to augment its capabilities. Analog communication between the added function modules and the base modules limits the cost of each. Many of the added function modules may also be implemented using low cost analog circuitry, but the high volumes obtainable with the shared low-cost base-module can make even high tier functionality, where the added function modules include microcontroller circuits, cost effective.

Specifically, the present invention provides a multi-function overload relay. A first portion of the multi-function overload relay is a base overload relay module having a first housing supporting first and second terminals where the second terminals are receivable by a contactor. Current conductors conduct current from the first terminals to the second terminals and solid-state analog circuitry monitors the current in the current conductors to produce a signal proportional to the current. The overload relay module includes an electrical connector extending from the wall of the housing and communicating with different points of the solid-state analog circuitry.

A second portion of the multi-function overload relay is an added-function module having a second housing attachable to the wall of the overload relay module. A second electrical connector located on the added-function module joins with the electrical connector of the overload module when the added-function module is attached to the wall of the housing. Ancillary circuitry within the added-function module communicates with the solid-state analog circuitry to augment its function.

Thus, it is one object of the invention to provide for a physical separation of the functions that maybe performed by an overload relay, allowing a variety of mid-tier overload relays of different functions to be offered in, a cost-effective basis. The analog interface between components allows division of functions to be accomplished with minimal interface cost.

It is another object of the invention to provide a base module for an overload relay that is competitive with the lowest cost overload relays of comparable performance, so as to provide a base unit that achieves low cost through high sales volume in multiple market tiers. Eliminating microcontroller circuitry in the base module makes this possible.

The ancillary circuitry may provide functions selected from the group consisting of motor jam detection, current imbalance detection, and ground fault current detection.

Thus it is another object of the invention to provide for a variety of additional features that may leverage the current sensing capabilities of the base module.

The ancillary circuitry may provide remote reset or trip of the overload relay.

Thus it is another object of the invention to provide remote resetting as an optional feature, thereby reducing the cost of the overload relay base module.

The second housing of the added-function module may include a network connector and the ancillary circuitry may provide an interface to a serial digital network connected at the network connector.

Thus it is an object of the invention to provide for optional network connection to an overload relay, without increasing the price of the base module of the overload relay.

The second housing of the added-function module may further include third terminals providing an interface for input and output signals, and the ancillary circuitry may provide an interface to a serial network allowing reading of the input signals at the third terminals and writing of the output signals at the third terminals.

Thus it is another object of the invention to make additional use of the complex circuitry required for a network interface to provide compact input/output capabilities at the overload relay.

The second housing may include captive machine screws received in corresponding holes in the first housing to attach the first housing to the second housing.

Thus it is another object of the invention to provide for an attachment method which does not increase the cost burden of the base module (which needs only molded holes) and yet which is robust against the high vibration environment of the overload relay unit when mounted on a contactor.

The first and second electrical connectors may communicate signals selected from the group consisting of an overload relay reset signal, a ground signal, a burden voltage signal, a thermal capacity utilization signal, an overload relay power supply signal, any applicable voltage reference signals, and overload relay trip and reset signals.

Thus it is another object of the invention to establish a set of core analog signals that may be communicated between the overload relay and the added-function module avoiding the need for a complex serial interface appropriate only for more expensive microcontroller circuitry in the base module.

The first terminals may be screw terminals receiving wires and the first housing may provide access to screws of the screw terminals along the first wall and receive the wires at a second wall perpendicular to the first wall, and the second housing may attach to the first housing at a third wall perpendicular to both the first and second walls.

Thus it is another object of the invention to provide for an attachment location the overload relay module that does not interfere with attachment of wires or pre-existing wire pathways used for the overload relay.

The second housing of the added-function module may further include third terminals providing connections to ancillary circuitry.

Thus it is another object of the invention to provide additional contact points to be added to the overload relay via the added function modules.

The input terminals may be connectors mating with the second connectors, the second connectors providing screw terminals for receiving wires.

Thus it is another object of the invention to accommodate tight clearance wiring conditions by allowing pre-wiring of the second connectors using screw terminals and then connection of the second connectors to the first connectors on the added-function module.

A kit may be provided having the overload relay base module described above and at least two added-function modules.

Thus it is another object of the invention to simplify the stocking and manufacturing of overload relays having different functions.

The kit may include a second overload relay module omitting the electrical connector extending from a wall of the housing.

Thus it is another object of the invention to provide the ability to provide a base module not compatible with the added function modules, for very low cost applications.

These particular objects and advantages may apply to only some embodiments falling within the claims and thus do not define the scope of the invention.

BRIEF DESCRIPTION OF THE DRAWINGS

FIG. 1 is a fragmentary, exploded, perspective view of an overload relay of the present invention showing joining of a base module and an added-function module and the base module to a contactor;

FIG. 2 is a fragmentary view of the base module of FIG. 1 in an embodiment omitting a connector between the base module and the added-function module;

DETAILED DESCRIPTION OF THE PREFERRED EMBODIMENT

Figure 3:
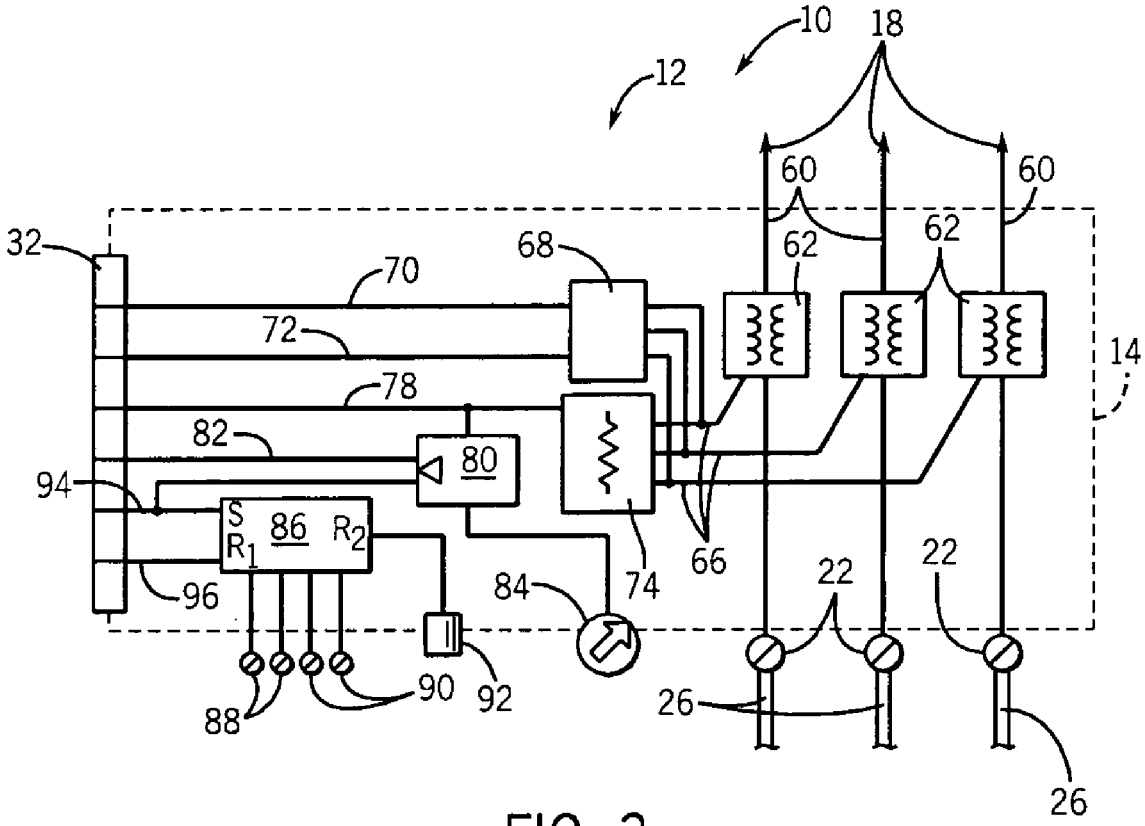
FIG. 3 is a block diagram of the analog solid-state circuitry of the overload relay showing development of interface signals for the added-function modules.

Referring now to FIG. 1, a modular overload relay system 10 includes a base module 12. The base module 12 has a housing 14 with a top wall 16 from which bayonet terminals 18 extend upwardly to be received by corresponding screw clamp terminals (not shown) of a contactor 20. Three bayonet terminals 18 are provided for three conductors of a three-phase power system.

Each of the bayonet terminals 18 is associated with a corresponding internal conductor 60 (shown in FIG. 3) within the base module 12 which leads to a corresponding screw clamp or cage clamp (screwless) terminal 22. The screw clamp terminals 22 are accessible from a front wall 24 of the housing 14 and allow the attachment lines 26 which may be received at a bottom wall 28 of the housing 14.

A side wall 30 of the housing 14 perpendicular to the top wall 16, the bottom wall 28, and the front wall 24, supports an outwardly facing electrical connector 32. The side wall 30 also has screw holes 34.

An added-function module 40 having a side wall 42 may attach to the side wall 30 of the base module 12 so that a second electrical connector 44 (not visible in FIG. 1) may mate with electrical connector 32 when the added-function module 40 is attached to the base module 12. Screws 36, captive in a housing 38 of an added-function module 40, may be threaded into the screw holes 34 of the side wall 30 of the base module 12. Alternatively snaps attached to or molded into housing 38 may engage corresponding holes in the side wall 30 of the base module 12. In either case, the cost burden of the attachment means on the base module 12 is minimized.

The mounting of the added-function module 40 at the side wall 30 provides clear access to the top wall 16, the front wall 24, and bottom wall 28 simplifying wiring of the base module 12.

A toggle switch array 46 may be exposed on a side wall 43 of the housing 38 of the added-function module 40 opposite the side wall 42 to allow optional programming of the functions of the circuitry contained in the added-function module 40. A bottom wall 48 of the added-function module 40 includes electrical connectors 50 (not visible in FIG. 1) receiving pins from mating electrical connectors 52 having screw clamp or cage clamp terminals for receiving wiring 56. The wiring 56 may be thus attached to the electrical connectors 52 prior to connection of the electrical connectors 52 to the added-function module 40 in this way accommodating possibly reduced clearance resulting from the use of the added-function module 40.

Referring now to FIG. 3, each of the bayonet terminals 18 communicate with a conductor 60 (which may be an extension of the bayonet terminals 18) passing through the housing 14 of the base module 12 to screw clamp terminals 22. A primary winding of a current transformer 62 is placed in series with each of these conductors 60 to allow measurement of the current passing through each of these conductors without significant power loss.

Leads 66 attached to the secondary windings each of the current transformers 62 received by a monitoring circuit 74 thereby simulating a burden resistor to determine a total RMS current delivered through each of the conductors 60 connected as a load across the three phase power, for example, as a composite load a Y or Delta configuration. The monitoring circuit 74 produces a burden resistor voltage 78 (or optionally three burden voltages associated with each of conductors 60) providing an instantaneous representation of total current flow.

Leads 66 attached to the secondary windings each of the current transformers 62 are also received by a power supply 68 taps a small amount of power from each of the conductors 60 to produce direct current (DC) power 70 referenced with respect to an internal ground 72 and used for operation of the circuitry of the base module 12 and optionally the added-function module 40. The amount of power tapped off conductors 60 for this purpose is minor and does not affect the overall calculation of overload currents or is compensated by the monitoring circuit 74 components.

The burden voltage 78 from the monitoring circuit 74 is received by an integrator/comparator 80 which produces a thermal capacity value (TCU) 82 being a combination of current and duration that models the amount of thermal capacity remaining in an associated motor that may be connected to lines 26. Integrator/comparator 80 applies a threshold determined by a potentiometer 84 which may be part of the 'burden resistor network' so as the potentiometer is adjusted, it actually adjusts the burden resistance. Because the secondary current stays relatively constant at a given primary current, adjusting the potentiometer 84 effectively alters the FLA setting of the overload relay. The potentiometer 84 is exposed at the front wall 24 of the housing 14 and provides a threshold level to integrator/comparator 80 to generate a set signal 94 that is communicated to a latched contact set 86 when the threshold has been exceeded indicating potential overload on the attached motor.

The latched contact set 86 provides a set of normally open contacts 88 and normally closed contacts 90 and receipt of the set signal closes the normally open contacts 88 and opens the normally closed contacts 90 which may be in series with the coil of the contactor 20 to break the electrical circuit of lines 26 under overload condition. The latched contact set 86 and the normally open contacts 88 and normally closed contacts 90 may be realized with solid-state elements such as transistors and need not be a mechanical latched relay as is understood in the art.

A front panel reset button 92 is provided to apply reset signal 96 to the latched contact set 86 to re-open the normally open contacts 88 and close the normally closed contacts 90.

The set signal 94, the reset signal 96, the TCU value 82, the burden voltage 78, the ground 72 and power 70, and any other voltage to be monitored may be provided to the electrical connector 32 for use by the added-function module 40. In this way various points within the analog circuitry implementing the component 68, 74, 80 and 86 may be accessible outside of the housing 14. All this circuitry may be realized by a low cost ASIC.

Referring still to FIG. 3, the above components 62, 68, 74, 80 and 86 provide a base functionality of an overload relay system 10 such as may be sold independently of the added-function module 40 and stocked or manufactured as part of a kit. Referring to FIG. 2, it will further be understood that for sales only with this basic functionality, the electrical connector 32 and its associated wiring may be eliminated further reducing the cost of the base module 12 while supporting high volumes for the components 62, 68, 74, 80 and 86 to lower their costs.

Figure 4:
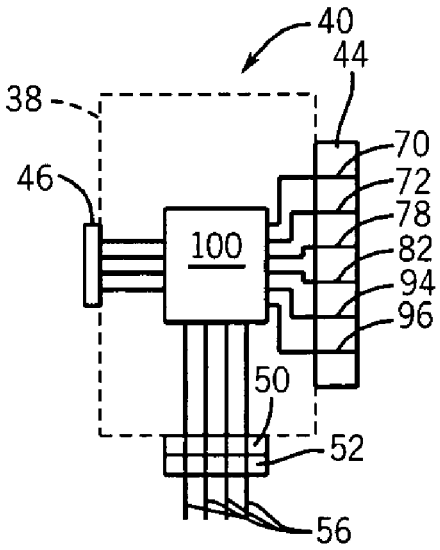
FIG. 4 is a simplified block diagram of a first added-function module making use of an application specific integrated circuit implementing analog circuitry such as may provide remote reset and other protected features.

Referring now to FIG. 4, the added-function module 40 when attached to the base module 12 may receive each of the signals 70, 72, 78, 82, 94 and 96 through electrical connector 44. These signals are routed to a a second set of analog solid state circuitry possibly realized by a second ASIC 100 implementing analog circuit blocks but without the microcontroller features of executing a program and whose functions will vary depending on the added function to be provided. Generally, the ASIC 100 will provide current integration with different time constants for jam detection, and comparator circuits for ground fault and current imbalance detection. More specifically, the ASIC 100 may monitor the burden voltage 78 to detect current use indicative of jam condition to provide a set signal 94 through electrical connector 44 to the latched contact set 86. By expanding the burden voltage 78 to three separate values obtainable from each of the current transformers 62 separately, the ASIC 100 may detect current imbalance in the phase or ground fault conditions, again asserting the set signal 94 when appropriate. In this regard, the ASIC 100 may also communicate with the toggle switch array 46 and possibly potentiometers (not shown) to set necessary variable parameters and determine its operating mode. Analog circuits for these functions are well known in the art and implementation in this invention will be understood to those of ordinary skill in the art from the above description.

The ASIC 100 may also communicate with electrical connectors 50 joined with wiring 56 via electrical connectors 52 to enable additional functions and applications. For example, one of the wires 56 may provide an external reset signal or trip signal which may be routed by the ASIC 100 to reset signal 96 to provide for resetting or tripping of the overload relay of the base module 12. Such a reset signal or trip signal may come from a remote electrical pushbutton or from a central controller.

Power for the ASIC 100 may be obtained by wiring 56 from an external source via electrical connectors 52 or from the power 70 of the base module 12.

Figure 5:
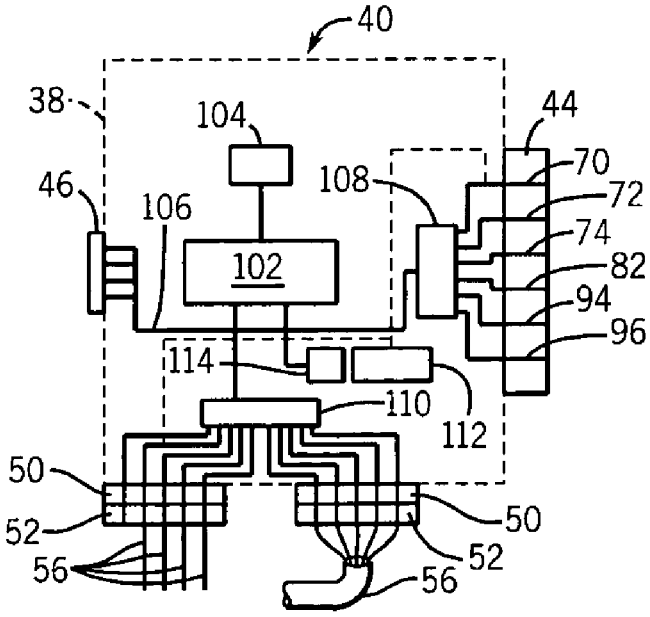
FIG. 5 is a figure similar to that of FIG. 4 showing an added-function module making use of a microcontroller for network communication, local input and output, and other control advanced protection functions.

Referring now to FIG. 5, a more advanced added function module 40 is contemplated which includes a microcontroller 102 providing internally a processor, a read only memory and sonic interface circuitry. The microcontroller 102 communicates with a clock circuit 104 and start up circuit 114, and via an internal bus 106, communicates with toggle switch array 46, interface circuit 108, and interface circuit 110. Interface circuit 108 communicates with electrical connector 44 and each of signals 70, 72, 78, 82, 94 and 96 and thus may include analog to digital and digital to analog circuits as well as level shifting circuits understood in the art, on an as needed basis. Interface circuit 110 (which may consist of one or more devices) communicates with the first and second electrical connectors 52 and 52' and thus with wiring 56 and may include protection, level shifting, and voltage or current limiting circuits understood in the art. Again, power can be obtained either through external wiring 56 or from the electrical connector 44 and processed by power circuitry 112 to be suitable for the microcontroller 102.

The microcontroller 102 executes a stored internal program to provide a variety of functions required in higher performance applications, for example, communication over a network implemented on wiring 56 running a DeviceNet protocol connected to electrical connectors 52'. With such a network connection, the added-function module 40 may allow a reading of any of the values from electrical connector 44 and a transmitting of those values to a remote location. For example, burden voltage 78, TCU 82 and power 70 may all be monitored. Alternatively or in addition, the network on wiring 56 may transmit signals converted by the microcontroller 102 to set signals 94 and reset signal 96 based on a remote command. Microcontrollers 102 pre-programmed to implement the well-known CAN protocol used in DeviceNet, and thus to permit bi-directional transfer of serial digital data, are available from a number of commercial vendors. Other networks such as Profibus, Modbus, and ASI may be used in lieu of DeviceNet.

The microcontroller 102 may also provide generalized input and output signals through electrical connectors 52, for example, monitoring the outputs of the latched contact set 86 being normally open contacts 88 and normally closed contacts 90 on the base module 12 or other local I/O functions including auxiliary contacts on the contactor and a possible circuit breaker attached to the system.

It will be understood that the use of the microcontroller 102 requires additional support circuitry and thus substantially increases the cost of the combined overload relay system 10, however, this allows the overload relay system 10 to meet performance requirements required of high tier units and may ultimately further lower the cost of the base module 12 through higher volumes.

It is specifically intended that the present invention not be limited to the embodiments and illustrations contained herein, but include modified forms of those embodiments including portions of the embodiments and combinations of elements of different embodiments as come within the scope of the following claims.

We claim:

1. A modular overload relay comprising:

a) a base overload relay module having:

i) a first housing supporting first terminals and second terminals, the second terminals receivable by a contactor;

ii) current conductors for conducting current from the first terminals to the second terminals;

iii) solid-state analog circuitry monitoring the current in the current conductors to produce an overload signal being a function of the current, the overload signal receivable by the contactor to open the contactor upon detection of an overload signal;

iv) an electrical connector extending from a wall of the first housing and communicating with different points in the solid-state analog circuitry;

b) an added function module having:

i) a second housing that is separate from the first housing and attachable to the wall of the first housing of the overload relay module;

ii) a second electrical connector joining with the electrical connector of the overload module when the added function module is attached to the wall of the first housing; and iii) ancillary circuitry communicating with the solid-state analog circuitry to augment a function of the solid-state analog circuitry;

wherein the base overload relay module is operable as an overload relay without being engaged with the added function module.

2. The modular overload relay of claim 1 wherein the ancillary circuitry provides an augmented function selected from the group consisting of: motor jam detection, current imbalance detection, and ground fault current detection.

3. The modular overload relay of claim 1 wherein the ancillary circuitry provides an augmented function selected from the group consisting of remote reset and remote trip of the overload relay.

4. The modular overload relay of claim 1 wherein the second housing of the added function module further includes a network connector and wherein the ancillary circuitry provides an interface of the modular overload relay to a serial digital network connected at the network connector.

5. The modular overload relay of claim 4 wherein the second housing of the added-function module further includes third terminals providing an interface for input and output signals and wherein the ancillary circuitry provides an interface to a serial digital network allowing reading of input signals at the third terminals and writing of output signals at the third terminals.

6. The modular overload relay of claim 1 wherein the second housing includes machine screws received in corresponding holes in the first housing to attach the first housing to the second housing.

7. The modular overload relay of claim 1 wherein the first and second electrical connector communicate signals selected from the group consisting of: an overload relay reset signal, a ground signal, a burden voltage signal, a thermal capacity utilization signal, an overload relay voltage signal, an overload trip signal, and a reset signal.

8. The modular overload relay of claim 1 wherein the first terminals are terminals receiving wires and wherein the first housing provides access to screws of the screw terminals along a first wall and receive the wires at a second wall perpendicular to the first wall and wherein the second housing attaches to the first housing at a third wall perpendicular to both the first and second walls.

9. The modular overload relay of claim 1 wherein the second housing of the added-function module further includes third terminals providing connection to the ancillary circuitry.

10. The modular overload relay of claim 9 wherein the third terminals are connectors mating with second connectors providing terminals for receiving wires.

11. The modular overload relay of claim 1 wherein the base overload relay module further includes a power supply tapping current from the power conductors to power the solid-state analog circuitry.

12. An overload relay kit comprising:

a) a base overload relay module having:

i) a housing supporting first terminals and second terminals, the second terminals receivable by a contactor;

ii) current conductors for conducting current from the first terminals to the second terminals;

iii) solid-state analog circuitry monitoring the current in the current conductors to produce an overload signal being a function of the current;

iv) an electrical connector extending from a wall of the housing and communicating with different points within the solid-state analog circuitry;

b) at least two added function modules each having:

i) a second housing alternately attachable to the wall of the first housing of the overload relay module;

ii) a second electrical connector joining with the electrical connector of the overload relay module when the added function module is attached to the wall of the first housing;

iii) ancillary circuitry communicating with the solid-state analog circuitry to augment the function of the solid-state analog circuitry when the added function module is attached to the wall of the first housing; and c) wherein the base overload relay module is configured to perform as an overload relay independently of the at least two added function modules.

13. The overload relay kit of claim 12 further including:

c) a second overload relay module omitting an electrical connector extending from a wall of the first housing and communicating with different points within the solid-state analog circuitry.

14. The overload relay kit of claim 12 wherein the ancillary circuitry provides a function selected from the group consisting of: motor jam detection, current imbalance detection, and ground fault current detection.

15. The overload relay kit of claim 12 wherein the ancillary circuitry provides an augmented function selected from the group consisting of remote reset and remote trip of the overload relay.

16. The overload relay kit of claim 12 wherein the second housing of the added function module further includes a network connector and wherein the ancillary circuitry provides an interface to a serial digital network connected at the network connector.

17. The overload relay kit of claim 16 wherein the second housing of the added-function module further includes third terminals providing an interface for input and output signals and wherein the ancillary circuitry provides an interface to a serial network allowing reading of input signals at the third terminals and writing of output signals at the third terminal.

18. The overload relay kit of claim 12 wherein the second housing includes machine screws received in corresponding holes in the first housing to attach the first housing to the second housing.

19. The overload relay kit of claim 12 wherein the first and second electrical connectors communicate signals selected from the group consisting of: an overload relay reset signal, a ground signal, a burden voltage signal, a thermal capacity utilization signal, an overload voltage signal, an overload trip signal, and a reset signal.

20. The overload relay kit of claim 12 wherein the first terminals are terminals receiving wires and wherein the first housing provides access to screws of the screw terminals along a first wall and receive the wires at a second wall perpendicular to the first wall and wherein the second housing attaches to the first housing at a third wall perpendicular to both the first and second walls.

21. An overload relay comprising:

a) a base overload relay module having:

i) a housing supporting first terminals and second terminals, the second terminals receivable by a contactor;

ii) current conductors for conducting current from the first terminals to the second terminals;

iii) circuitry monitoring the current in the current conductors to produce an overload signal being a function of the current;

iv) a power supply circuit tapping power from the current conductors to produce an isolated power source;

iv) an electrical connector extending from a wall of the housing and communicating with the monitoring circuitry;

b) a network communication module having:

i) a second housing that is separate from the housing of the overload relay module and attachable to the wall of the housing of the overload relay module;

ii) a second electrical connector joining with the electrical connector of the overload relay module when the network communication module is attached to the wall of the housing;

iii) a network connector attachable to a serial communication network; and iv) network interface circuitry communicating with the network connector and with the monitoring circuitry to provide an interface between the overload relay and a network.

22. The overload relay kit of claim 21 wherein the first terminals are screw terminals receiving wires and wherein the housing of the overload relay module provides access to screws of the screw terminals along a first wall and receive the wires at a second wall perpendicular to the first wall and wherein the second housing attaches to the first housing at a third wall perpendicular to both the first and second walls.

* * * * *